US011825994B2

(12) United States Patent
Brill et al.

(10) Patent No.: US 11,825,994 B2
(45) **Date of Patent: *Nov. 28, 2023**

(54) ONE-PIECE SHOWER BASE

(71) Applicant: INFINITY DRAIN LTD., Amityville, NY (US)

(72) Inventors: Jonathan Brill, Amityville, NY (US); Alan Trink, Amityville, NY (US); Bhasnarine Ramkarran, Amityville, NY (US)

(73) Assignee: INFINITY DRAIN LTD., Amityville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/665,858

(22) Filed: Feb. 7, 2022

(65) Prior Publication Data

US 2022/0160182 A1 May 26, 2022

Related U.S. Application Data

(63) Continuation of application No. 16/718,378, filed on Dec. 18, 2019, now Pat. No. 11,241,121.

(60) Provisional application No. 62/781,914, filed on Dec. 19, 2018.

(51) Int. Cl.
*A47K 3/40* (2006.01)
*E03F 5/04* (2006.01)

(52) U.S. Cl.
CPC ..... *A47K 3/40* (2013.01); *E03F 5/0408* (2013.01)

(58) Field of Classification Search
CPC ..... A47K 3/40; E03F 5/04
USPC ..... 4/613
See application file for complete search history.

(56) References Cited

U.S. PATENT DOCUMENTS

| | | | | |
|---|---|---|---|---|
| 10,130,220 | B2 * | 11/2018 | Roberts | A47K 3/40 |
| 2009/0064630 | A1 * | 3/2009 | Torres | A47K 3/40 52/741.1 |
| 2010/0071125 | A1 * | 3/2010 | Miller | A47K 3/40 29/527.4 |
| 2014/0033425 | A1 * | 2/2014 | Cook | B29C 45/14 29/428 |
| 2014/0075666 | A1 * | 3/2014 | Campbell | A47K 3/40 29/527.1 |
| 2016/0177561 | A1 * | 6/2016 | DeJesus | E03F 5/0407 52/745.13 |
| 2017/0326615 | A1 * | 11/2017 | Roy | A47K 3/40 |

(Continued)

OTHER PUBLICATIONS

Office Action dated Jun. 17, 2021 in Corresponding U.S. Appl. No. 16/718,378.

*Primary Examiner* — Christine J Skubinna
(74) *Attorney, Agent, or Firm* — F. Chau & Associates, LLC

(57) ABSTRACT

A one-piece shower base includes a pitched bottom surface, a plurality of vertical flanges extending upward from a plurality of outer edges of the one-piece shower base, a drain integrated within the one-piece shower base, and a pitched foam support base having an upper surface and a lower surface. The pitched bottom surface is pitched downward in at least one direction toward the drain. The upper surface of the pitched foam support base is adhered to an underside of the pitched bottom surface. The pitched foam support base fills in a hollow space below the underside of the pitched bottom surface created by the pitch of the pitched bottom surface.

15 Claims, 8 Drawing Sheets

(56) References Cited

U.S. PATENT DOCUMENTS

2020/0214510 A1 7/2020 Brill et al.

* cited by examiner

ONE-PIECE SHOWER BASE

CROSS-REFERENCE TO RELATED APPLICATIONS

This application is a continuation application of U.S. patent application Ser. No. 16/718,378, filed on Dec. 18, 2019, which claims priority to and the benefit of U.S. Provisional Application Ser. No. 62/781,914 filed on Dec. 19, 2018, the disclosures of which are herein incorporated by reference in their entireties.

TECHNICAL FIELD

Exemplary embodiments of the present invention relate to a shower base, and more particularly, to a one-piece shower base allowing for faster and more efficient installation.

DISCUSSION OF THE RELATED ART

In a conventional shower installation, a shower is typically assembled piece-by-piece by coupling various parts to one another, and a mortar bed is typically created to provide structural support and to create a pitch on the floor of the shower to cause water to move in a direction toward the drain of the shower for proper drainage.

The need for the creation of the mortar bed results in a number of disadvantages. For example, the creation of the mortar bed may be messy and time-consuming, since spreading and packing the mortar in the installation area is not a clean process (e.g., care must be taken to prevent the mortar from being disposed and set in unwanted places such as the drain body), and since creating a mortar bed to have the desired pitch is time consuming. Further, even once the mortar bed has been properly laid, the mortar bed must be allowed to set before installation can continue. Setting of the mortar bed takes hours, and in some cases, can take anywhere between 24 and 48 hours.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION

Figure 1:
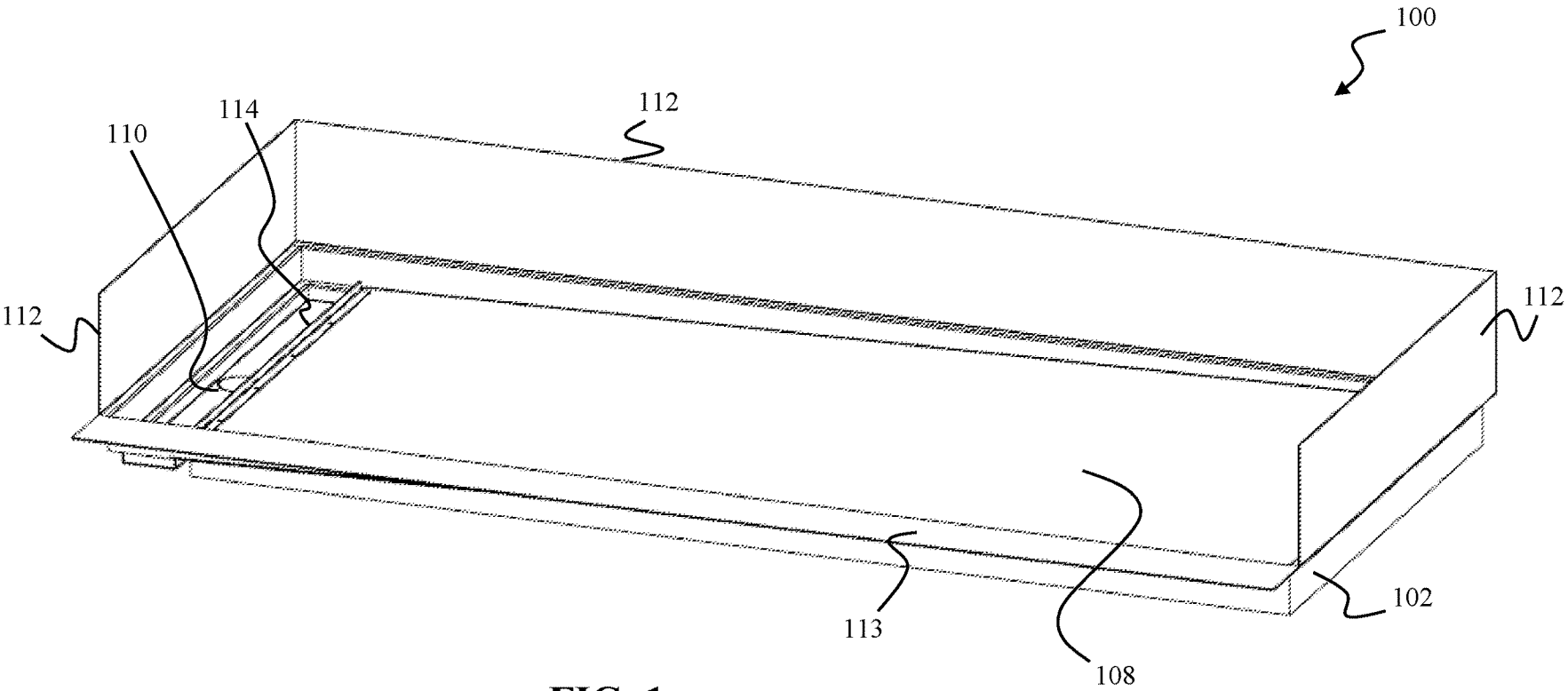
FIG. 1 is a perspective view illustrating a one-piece shower base according to exemplary embodiments of the present invention.

Exemplary embodiments of the present invention will be described more fully hereinafter with reference to the accompanying drawings Like reference numerals may refer to like elements throughout the accompanying drawings.

Hereinafter, spatially relative terms, such as "beneath", "below", "lower", "under", "above", "upper", etc., may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below.

It will be understood that the terms "first," "second," "third," etc. are used herein to distinguish one element from another, and the elements are not limited by these terms. Thus, a "first" element in an exemplary embodiment may be described as a "second" element in another exemplary embodiment.

It should be understood that descriptions of features or aspects within each exemplary embodiment should typically be considered as available for other similar features or aspects in other exemplary embodiments, unless the context clearly indicates otherwise.

As used herein, the singular forms "a", "an" and "the" are intended to include the plural forms as well, unless the context clearly indicates otherwise.

It will be understood that when a component is referred to as being "on", "connected to", "coupled to", or "adjacent to" another component, it can be directly on, connected, coupled, or adjacent to the other component, or intervening components may be present. It will also be understood that when a component is referred to as being "between" two components, it can be the only component between the two components, or one or more intervening components may also be present. Other words use to describe the relationship between components should be interpreted in a like fashion.

Herein, when one value is described as being about equal to another value or being substantially the same as or equal to another value, it is to be understood that the values are equal to each other within a measurement error, or if measurably unequal, are close enough in value to be functionally equal to each other as would be understood by a person having ordinary skill in the art. For example, the term as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations as understood by one of the ordinary skill in the art. Further, it is to be understood that while parameters may be described herein as having "about" a certain value, according to exemplary embodiments, the parameter may be exactly the certain value or approximately the certain value within a measurement error as would be understood by a person having ordinary skill in the art.

It will be further understood that when two components or directions are described as extending substantially parallel or perpendicular to each other, the two components or directions extend exactly parallel or perpendicular to each other, or extend approximately parallel or perpendicular to each other within a measurement error as would be understood by a person having ordinary skill in the art. Similarly, when two components are described as being substantially aligned with each other or substantially coplanar with each other, it is to be understood that the two components are exactly aligned with each other or exactly coplanar with each other, or are approximately aligned with each other or approximately coplanar with each other within a measurement error as would be understood by a person having ordinary skill in the art. Similarly, when a component is described as being substantially flat, it is to be understood that the component is exactly flat, or is approximately flat within a measurement error as would be understood by a person having ordinary skill in the art.

Figure 2:
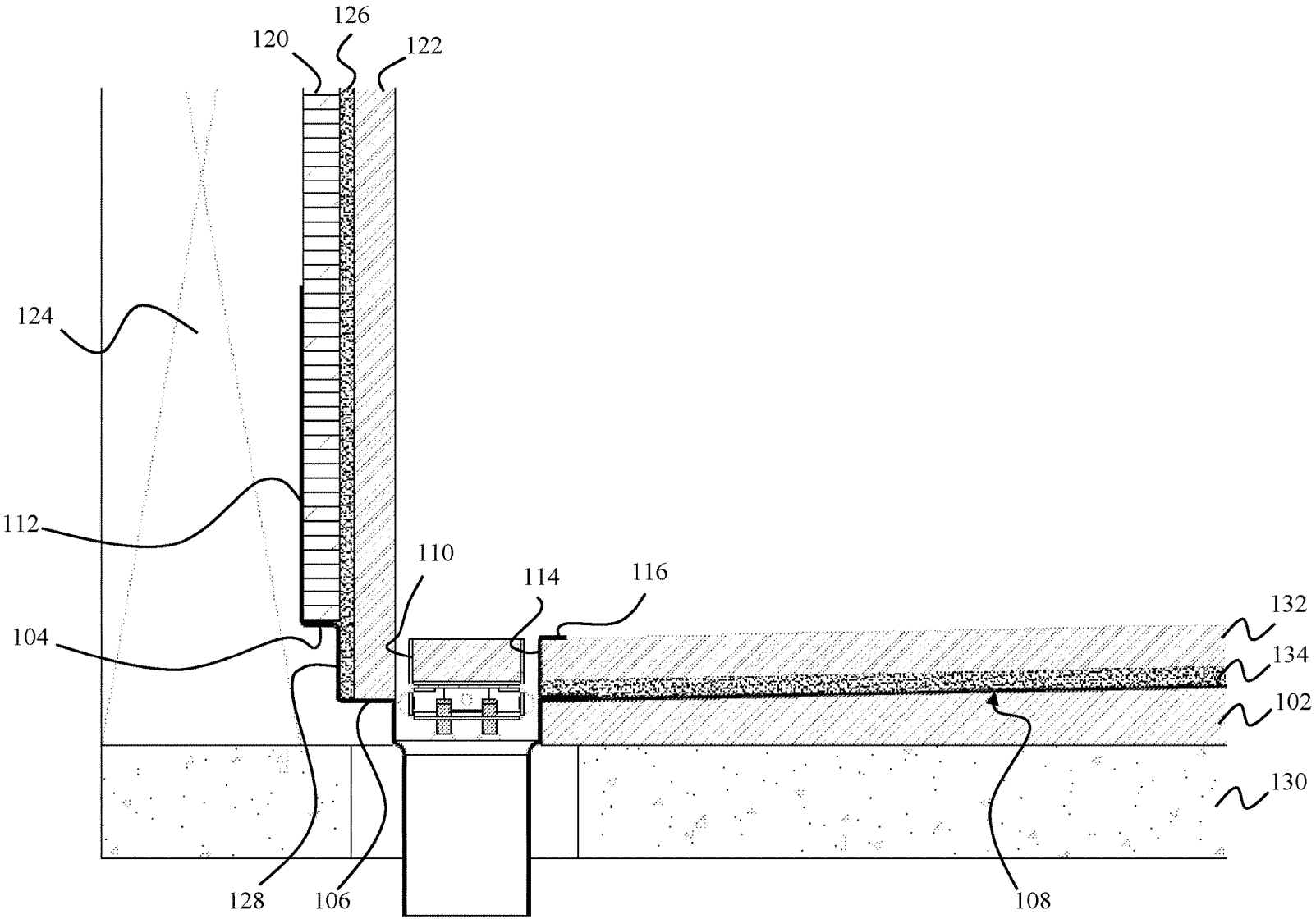
FIG. 2 is a cross-sectional view illustrating a one-piece shower base according to an exemplary embodiment of the present invention.
Figure 3B:
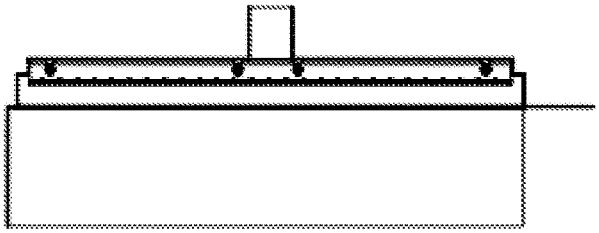
FIG. 3B is a cross-sectional view taken along line A-A of FIG. 3A.
Figure 3A:
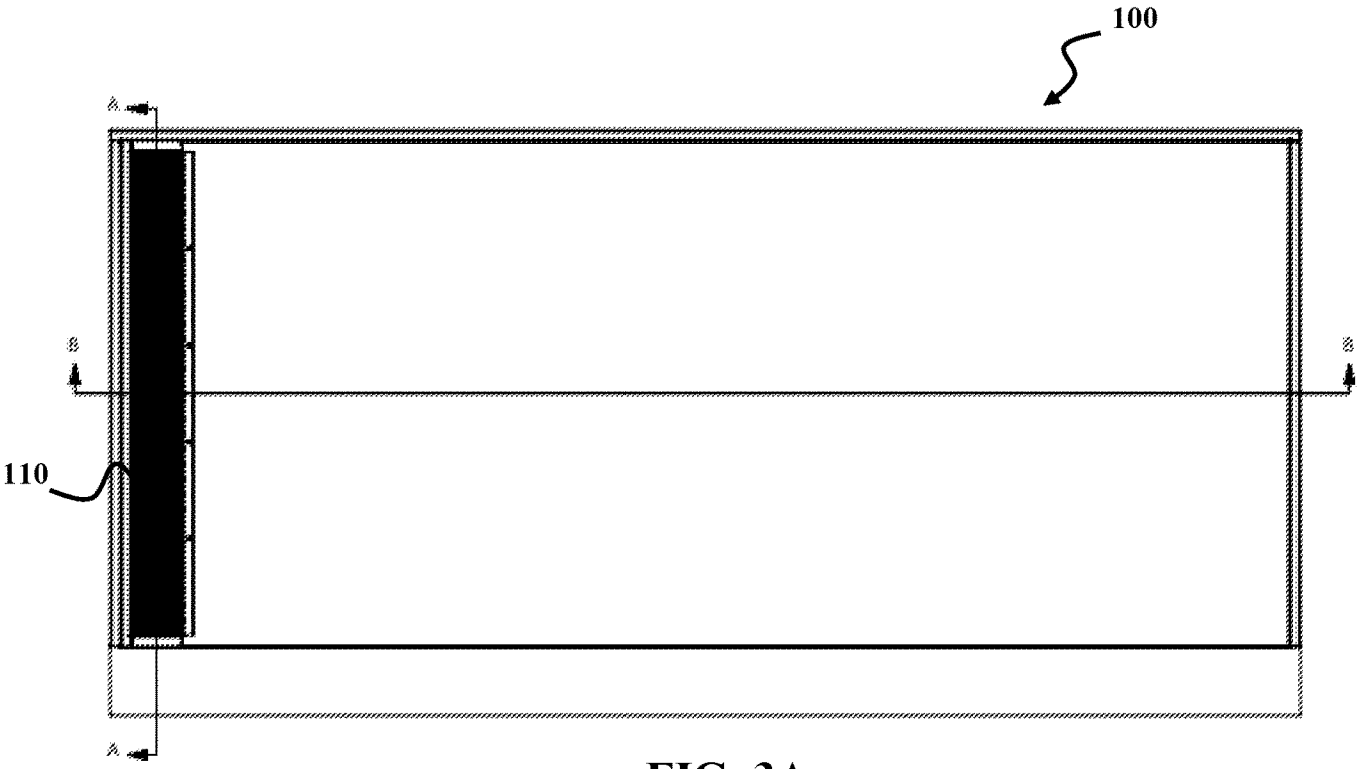
FIG. 3A is a plan view illustrating a one-piece shower base including an integrated linear drain according to an exemplary embodiment of the present invention.
Figure 3C:
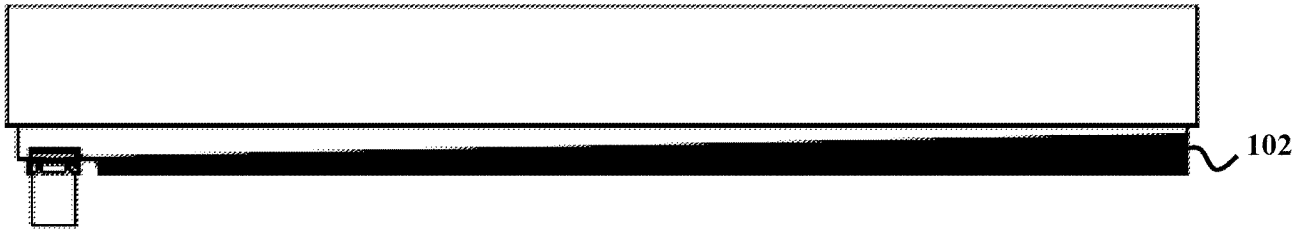
FIG. 3C is a cross-sectional view taken along line B-B of FIG. 3A.
Figure 4B:
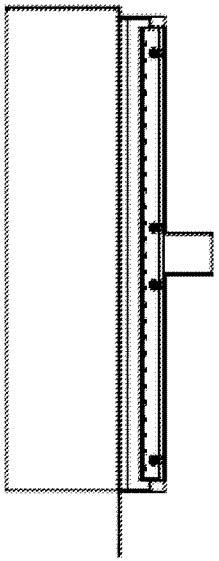
FIG. 4B is a cross-sectional view taken along line A-A of FIG. 4A.
Figure 4A:
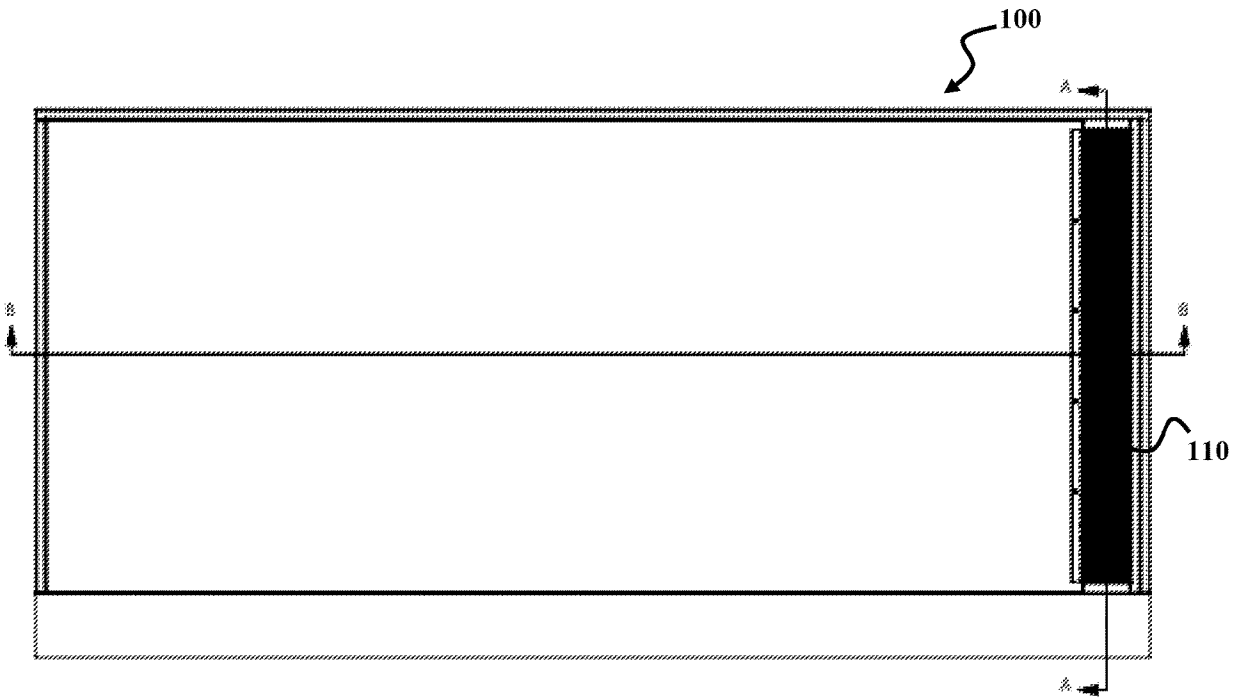
FIG. 4A is a plan view illustrating a one-piece shower base including an integrated linear drain according to an exemplary embodiment of the present invention.
Figure 4C:
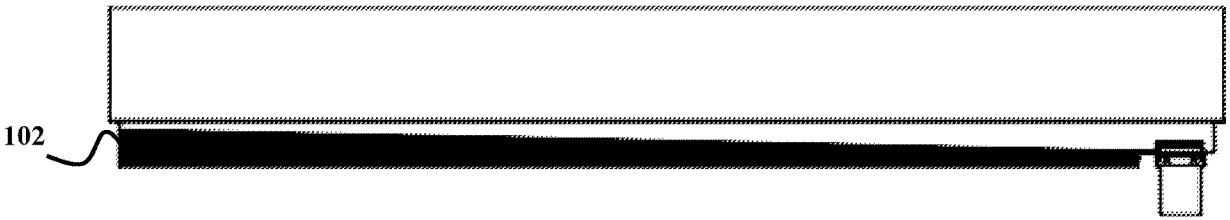
FIG. 4C is a cross-sectional view taken along line B-B of FIG. 4A.
Figure 5B:
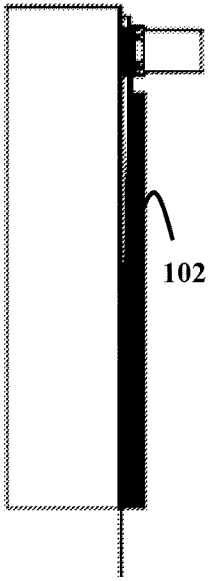
FIG. 5B is a cross-sectional view taken along line A-A of FIG. 5A.
Figure 5A:
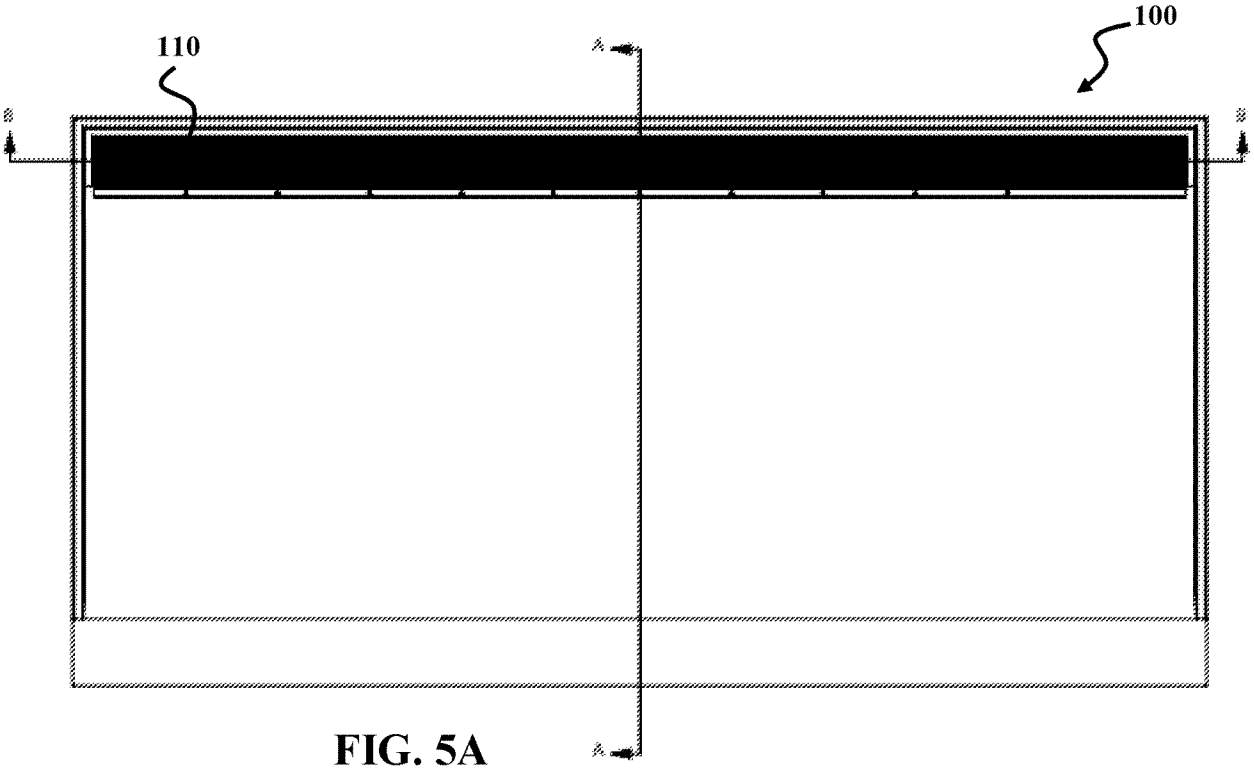
FIG. 5A is a plan view illustrating a one-piece shower base including an integrated linear drain according to an exemplary embodiment of the present invention.
Figure 5C:
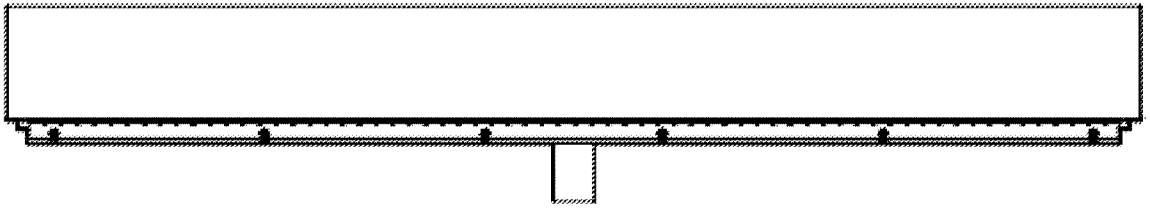
FIG. 5C is a cross-sectional view taken along line B-B of FIG. 5A.
Figure 6B:
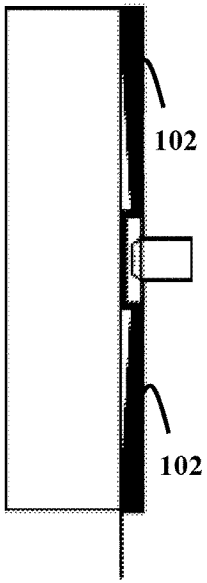
FIG. 6B is a cross-sectional view taken along line A-A of FIG. 6A.
Figure 6A:
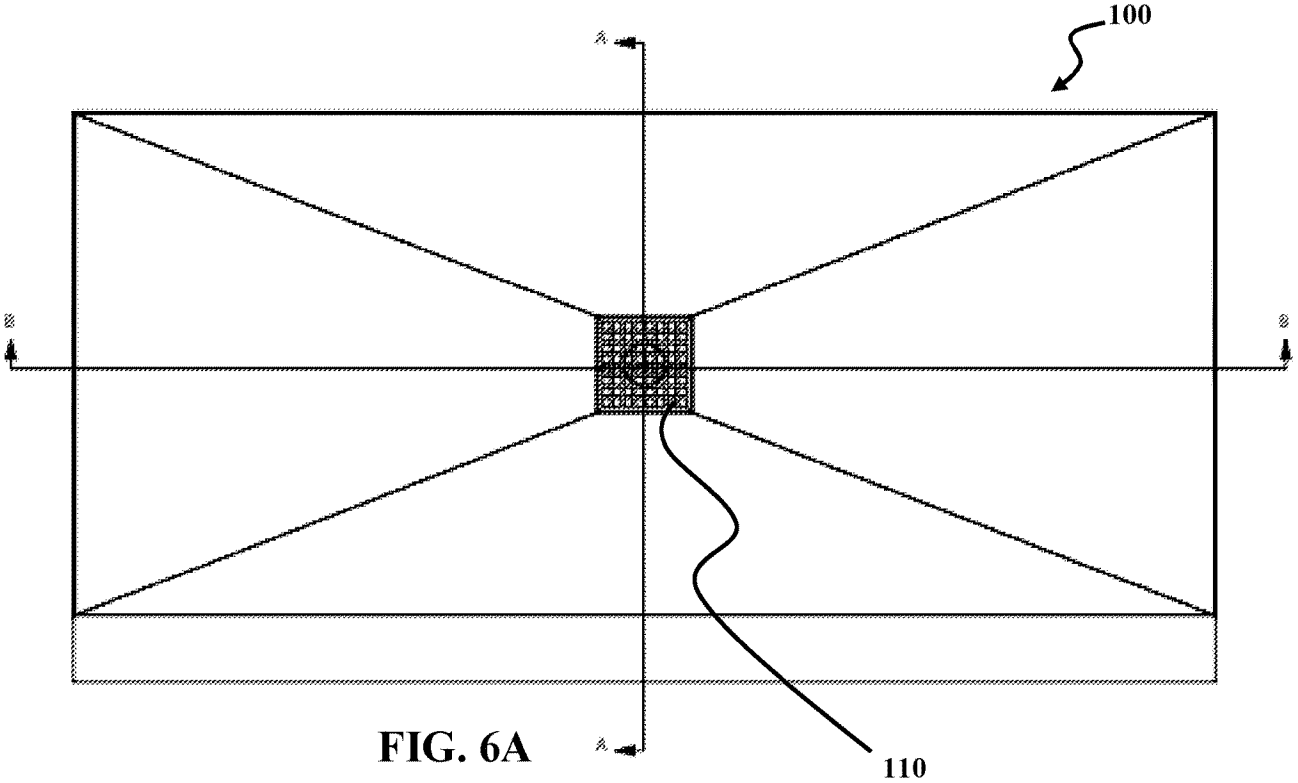
FIG. 6A is a plan view illustrating a one-piece shower base including an integrated center drain according to an exemplary embodiment of the present invention.
Figure 6C:
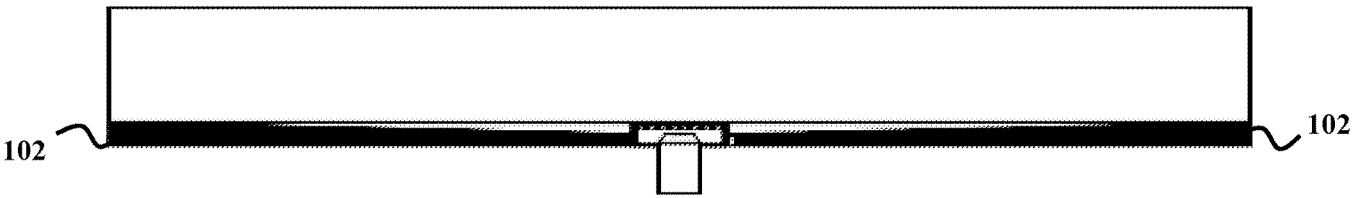
FIG. 6C is a cross-sectional view taken along line B-B of FIG. 6A.
Figure 7B:
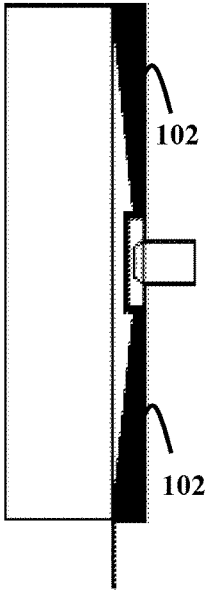
FIG. 7B is a cross-sectional view taken along line A-A of FIG. 7A.
Figure 7A:
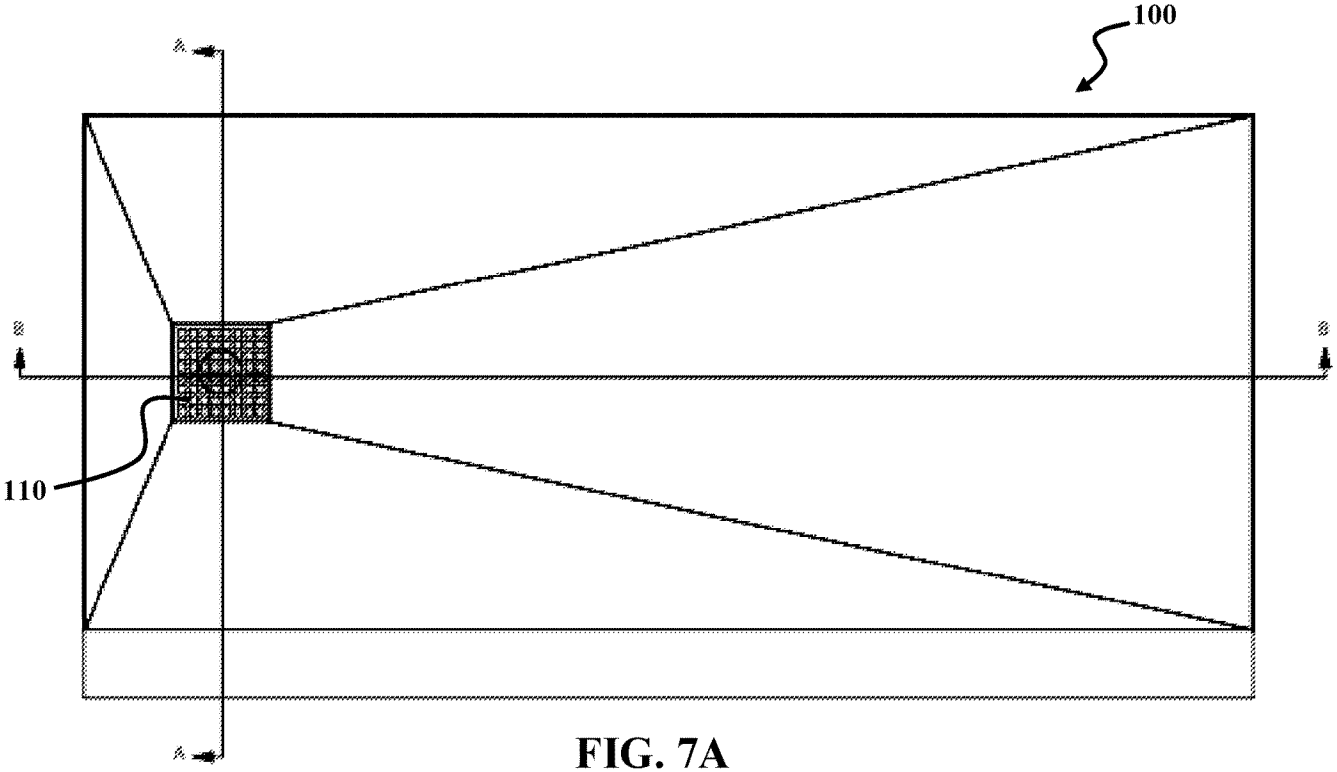
FIG. 7A is a plan view illustrating a one-piece shower base including an integrated center drain according to an exemplary embodiment of the present invention.
Figure 7C:
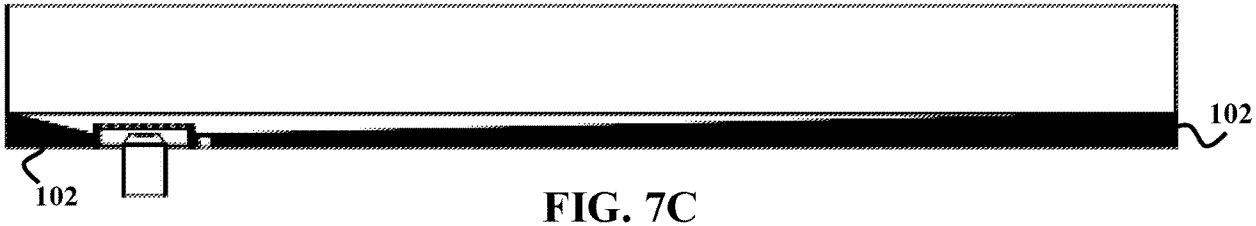
FIG. 7C is a cross-sectional view taken along line B-B of FIG. 7A.
Figure 8B:
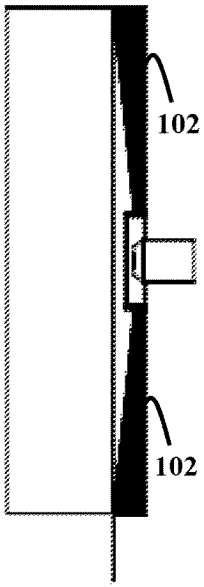
FIG. 8B is a cross-sectional view taken along line A-A of FIG. 8A.
Figure 8A:
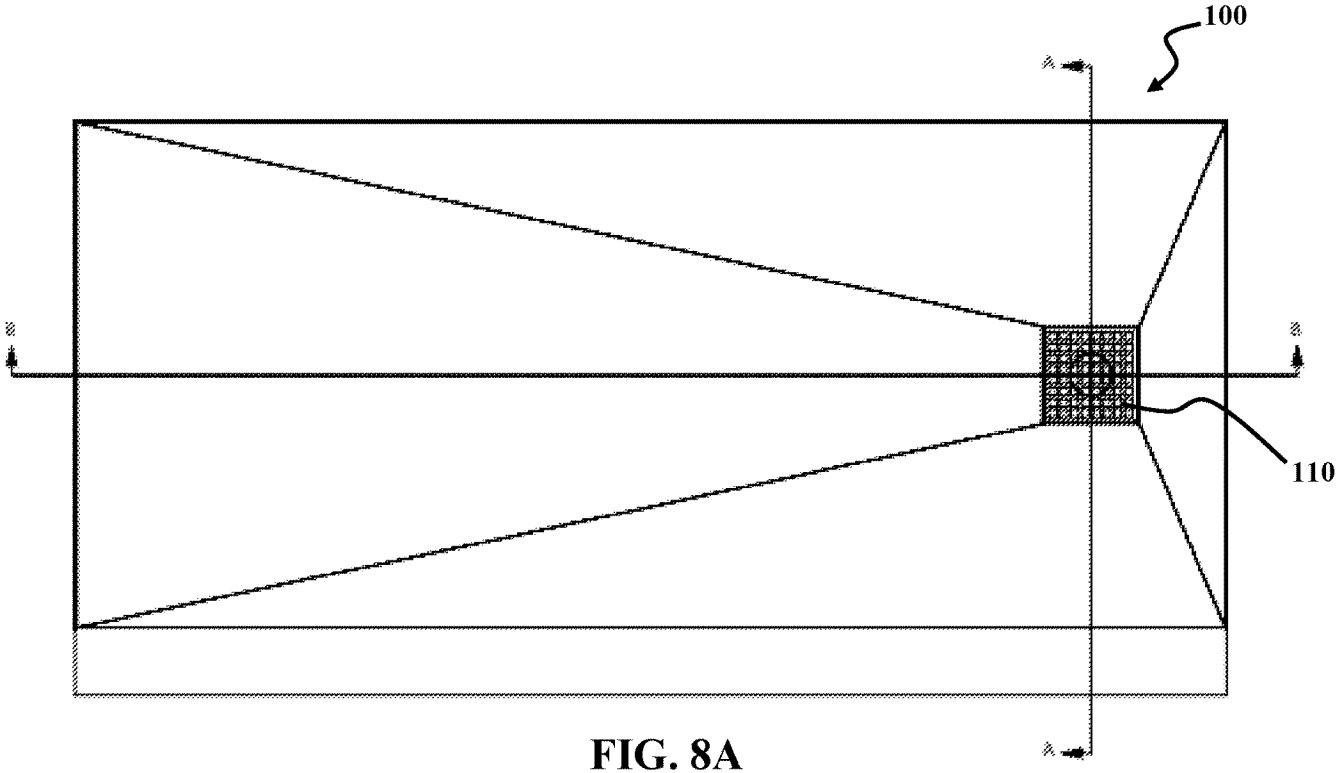
FIG. 8A is a plan view illustrating a one-piece shower base including an integrated center drain according to an exemplary embodiment of the present invention.
Figure 8C:
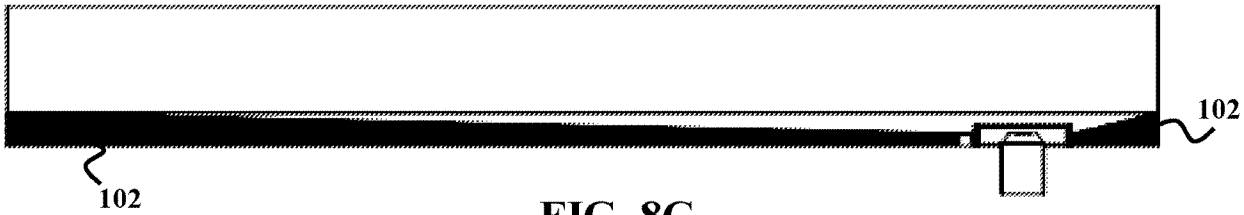
FIG. 8C is a cross-sectional view taken along line B-B of FIG. 8A.

FIG. 1 is a perspective view of a one-piece shower base according to exemplary embodiments of the present invention. FIG. 2 is a cross-sectional view of a one-piece shower base according to an exemplary embodiment of the present invention. FIG. 2 corresponds to the left portion of FIG. 1 in an area in which a drain is disposed.

Referring to FIGS. 1 and 2, exemplary embodiments of the present invention provide a one-piece shower base 100 to be installed in, for example, a bathroom shower. Unlike conventional shower installations, which include assembling a shower piece-by-piece by coupling various parts to one another, the shower base 100 according to exemplary embodiments is manufactured and installed as a single piece. For example, rather than building a shower by coupling various parts to one another, the one-piece shower base 100 allows for a more efficient and convenient installation in which a single receptacle is installed. The one-piece shower base 100 is custom sizable, sets shower framing for exact wall to wall installation, and allows for a flush installation against the wall adjacent thereto.

Since the one-piece shower base 100 is a single piece, the one-piece shower base 100 may be completely waterproof. As a result, there is no need to install additional waterproofing when installing the one-piece shower base 100, resulting in a more cost-effective and efficient installation. The one-piece shower base 100 may be made of, for example, stainless steel, and may be pre-primed.

According to exemplary embodiments, the one-piece shower base 100 includes a pitched foam support base 102 adhered to the bottom surface of the one-piece shower base 100. The pitched foam support allows for the one-piece shower base 100 to be installed without the use of a mortar bed. This advantage over conventional shower installations is described in further detail below.

According to exemplary embodiments, the one-piece shower base 100 includes a double flange structure including a backerboard stopper 104 (also referred to as a backerboard flange) and a wall finish stopper 106 (also referred to as a wall finish flange). The double flange structure allows for a backerboard and wall finish to be more easily and more stably installed, and the overlap of the backerboard and the wall finish in conjunction with the backerboard stopper 104 and the wall finish stopper 106 results in a waterproof characteristic of the one-piece shower base 100, as will be described in further detail below. Herein, the term "wall finish" refers to an outermost surface of the wall that is visible in an installed shower. These advantages over conventional shower installations will be described in further detail below.

Referring to FIGS. 1 and 2, the one-piece shower base 100 includes a pitched bottom surface 108 and a drain 110 integrated within the one-piece shower base 100. Integration of the drain 110 within the one-piece shower base results in faster and more efficient installation. Although FIGS. 1 and 2 illustrate the drain 110 as a linear drain, exemplary embodiments are not limited thereto. For example, in exemplary embodiments, the drain 110 may instead be a center drain. In addition, although FIGS. 1 and 2 illustrate a linear drain 110 being disposed along a short end of the one-piece shower base 100, exemplary embodiments are not limited thereto. For example, the linear drain 110 may instead be disposed along a long end of the one-piece shower base. FIGS. 3A to 8C illustrate exemplary embodiments in which the drain 110 is a linear drain or a center drain, and in which the drain 110 is disposed at different positions in the one-piece shower base 100.

A linear drain may refer to an elongated drain channel that may be positioned, for example, along a wall or along the threshold of a shower enclosure (see, e.g., FIGS. 3A-3C, 4A-4C and 5A-5C). A center drain may refer to a non-elongated drain channel that may be positioned, for example, away from a wall or threshold of a shower enclosure (see, e.g., FIGS. 6A-6C, 7A-7C and 8A-8C).

The one-piece shower base 100 may be manufactured such that its bottom surface 108 is pre-pitched/pre-sloped. For example, to allow for water to properly drain through the drain 110, when manufactured, the bottom surface 108 of the one-piece shower base 100 may be pre-pitched at an angle such that water is directed toward the drain 110 by way of gravity, allowing for proper drainage. Since the bottom surface 108 of the one-piece shower base 100 itself is pre-pitched, and since the one-piece shower base 100 includes the pitched foam support base 102, which is described in further detail below, there is no need to create a slope on the floor (e.g., by way of creating a pitched mud bed) during installation, resulting in a faster and more efficient installation process.

If the one-piece shower base 100 includes a linear drain 110 disposed at an end of the one-piece shower base 100, as illustrated in FIGS. 1 and 2, the bottom surface 108 of the one-piece shower base 100 may be pitched downward in one direction toward the end at which the drain 110 is disposed. For example, as shown in FIGS. 1 and 2, the bottom surface 108 of the one-piece shower base 100 is pitched downward from a rightmost end toward a leftmost end adjacent to the linear drain 110. If the one-piece shower base 100 instead includes a center drain disposed near the center of the one-piece shower base 100, the one-piece shower base 100 may be pitched in two directions toward the center of the one-piece shower base 100. For example, the one-piece shower base 100 may be pitched downward from a first end of the one-piece shower base 100 toward the center, and further pitched downward from a second end of the one-piece shower base 100 opposite the first end toward the center. When the one-piece shower base 100 is pitched in more than one location, a plurality of pitched foam support bases 102 may be disposed on the underside of the pitched bottom surface 108 in areas corresponding to the pitched locations of the pitched bottom surface 108 (see, e.g., FIGS. 6A-6C, 7A-7C, and 8A-8C).

A floor finish 132 may be installed onto the topside of the pitched bottom surface 108 of the one-piece shower base 100. Herein, the term "floor finish" refers to an outermost surface of the floor that is visible in an installed shower. The floor finish 132 may be, for example, a plurality of tiles and grout disposed between the tiles, a stone finish, etc. An adhesive such as, for example, a thinset mortar, may be used to adhere the floor finish 132 to the pitched bottom surface 108.

The one-piece shower base 100 may include a floor finish stopper 114 (also referred to as a floor finish flange or a floor finish lip) extending upward from an edge of the pitched bottom surface 108 where the pitched bottom surface 108 meets the drain 110. The floor finish stopper 114 may be made of the same material as the one-piece shower base 100. For example, when the one-piece shower base 100 is stainless steel, the floor finish stopper 114 may be stainless steel.

The floor finish stopper 114 receives a side surface of a floor finish 132 installed onto the pitched bottom surface 108. The floor finish 132 may be, for example, a plurality of tiles and grout disposed between the tiles, a stone finish, etc. Thus, for example, the floor finish stopper 114 may receive a side surface of tiles or a side surface of stone installed onto the pitched bottom surface 108. The floor finish stopper 114 is raised a small distance above the pitched bottom surface 108. The raised distance may vary according to exemplary embodiments depending on the type of floor finish 132 being installed. For example, in exemplary embodiments, the raised distance may be between about 1 inch and about 3 inches. However, exemplary embodiments are not limited thereto.

As a result of the floor finish stopper 114 protruding above the pitched bottom surface 108, when the floor finish 132 (e.g., tiles or stone) is installed onto the pitched bottom surface 108, the floor finish 132 is prevented from extending beyond the pitched bottom surface 108 and being disposed over the linear drain 110. This prevents the floor finish 132 from blocking the linear drain 110, which could impede the flow of water draining through the linear drain 110. In exemplary embodiments, the floor finish stopper 114 may further include a lateral stopper portion 116 that extends substantially perpendicular from the top of the floor finish stopper 114 away from the drain and extends substantially parallel to the subfloor 130. A side surface of the floor finish 132 may be pushed up against and contact the floor finish stopper 114 and inserted underneath this lateral stopper portion 116, and an upper surface of the floor finish 132 may contact this lateral stopper portion 116, which may assist in stabilizing the position of the floor finish 132 during installation and in securing the floor finish 132 to the pitched bottom surface 108 after installation.

The floor finish stopper 114 may include a plurality of weep holes formed therein. In the event that water seeps through, for example, cracks in the floor finish 132, the weep holes may allow this water to drain into the drain 110 instead of being trapped below the floor finish 132, thus preventing or reducing water damage.

The one-piece shower base 100 may include a plurality of vertical flanges 112 extending upward from outer edges of the one-piece shower base 100. Although the one-piece shower base 100 illustrated in FIG. 1 includes three vertical flanges 112, exemplary embodiments are not limited thereto. For example, an exemplary embodiment of the one-piece shower base 100 configured for installation in a corner may included only two vertical flanges 112, which when installed, respectively contact the two walls forming the corner.

The one-piece shower base 100 may include the pitched foam support base 102. For example, the pitched foam support base 102 may be adhered (e.g., via an adhesive) to the underside of the pitched bottom surface 108 of the one-piece shower base 100 during manufacture. Thus, when purchased, the purchaser does not have to install the pitched foam support base 102 onto the bottom surface 108 of the one-piece shower base 100. The pitched foam support base 102 has a pitch matching that of the pitched bottom surface 108. As a result, the pitched foam support base 102 may absorb any spaces or gaps present below the pitched bottom surface 108.

For example, because the bottom surface 108 of the one-piece shower base 100 is pitched, and because the subfloor 130 onto which the one-piece shower base 100 is installed is typically substantially flat and not pitched, the pitch of the bottom surface 108 creates a hollow space underneath the bottom surface 108 and above the subfloor 130. The pitched foam support base 102 fills this hollow space (e.g., fills an entirety of this hollow space) that results from the difference in slope between the pitched bottom surface 108 and the subfloor 130. The pitched foam support base 102 may be formed of, for example, expanded polystyrene (EPS). In an exemplary embodiment, 2 pound or 3 pound density EPS foam sheets may be used to form the pitched foam support base 102. However, exemplary embodiments of the present invention are not limited thereto.

Utilization of the pitched foam support base 102 allows the one-piece shower base 100 to be installed onto the subfloor 130 without the need to first create a primary mortar bed on the subfloor 130. This is because the pitched foam support base 102 provides structural support for the one-piece shower base 100 while maintaining the pre-sloped nature of the one-piece shower base 100. To illustrate the improvement provided by way of utilization of the pitched foam support base 102, a conventional shower installation is described below, and is compared to installation of the one-piece shower base 100 according to exemplary embodiments of the present invention.

In a conventional shower installation, the wall for the area intended for the shower is framed out using, for example, wood or metal studs. Then, a clamp down drain body is installed onto the subfloor or a slab, and is connected to the plumbing. Once this is done, a primary mortar bed, which is pitched toward the drain, is created on the subfloor.

The primary mortar bed typically serves two primary purposes in a conventional shower installation. For example, the primary mortar bed may provide structural support for the floor finish being installed in the shower, and may provide a pitch/slope for the floor finish being installed in the shower to cause water to drain off of the floor finish in a direction toward the drain. The primary mortar bed is typically cementitious based and includes different materials. For example, the primary mortar bed may be formed by mixing cement and sand with water, has a thickness greater than ½", and is used for building and not for providing adhesive properties. For example, during a conventional shower installation, the primary mortar bed is created to provide structural support (not adhesion to an adjacent surface). It is noted that this primary mortar bed is not the same as a thinset mortar, which may also include some mixture of cement, sand and water, but which also includes additives providing adhesive properties, and which is less than ½" thick. As its name suggests, a thinset mortar is intended to be as thin as possible such that it only provides adhesion, and does not cause any changes to the structure or sizing of the installation in which it is being used. For example, a primary mortar bed is not adhesive, provides structural support once set, and has a thickness greater than ½", while a thinset mortar is adhesive, does not provide structural support, and has a thickness less than about ½".

The need for the creation of the primary mortar bed during a conventional shower installation results in a number of disadvantages. For example, the creation of the primary mortar bed may be messy and time-consuming, since spreading and packing the mortar in the installation area is not typically a clean process (e.g., care must be taken to prevent the mortar from being disposed and set in unwanted places such as the drain body), and since creating a primary mortar bed to have the desired pitch/slope is time consuming. Further, even once the primary mortar bed has been properly laid, the primary mortar bed must be allowed to set (e.g., dry) before installation can continue. Setting of the primary mortar bed takes hours, and in some cases, can take anywhere between 24 and 48 hours.

Still referring to the conventional shower installation, once the primary mortar bed has been allowed to set, a waterproofing membrane is spread over the primary mortar bed and up the walls from the floor, and is attached to the drain body. A drain (e.g., a linear drain or a center drain) is then attached to the drain body and is adjusted for height. A secondary mortar bed, which is similar to the primary mortar bed in regard to providing both structural support and proper pitching, is then created on the waterproofing membrane. Once the secondary mortar bed has been given sufficient time to set, a backerboard is installed onto the shower walls, and the wall finish and floor finish are then attached to the backerboard and the secondary mortar bed, respectively, using an adhesive such as, for example, a thinset mortar.

Unlike the conventional shower installation described above, installation using the one-piece shower base according to exemplary embodiments of the present invention provides advantages in terms of, for example, the ease of installation, the time taken for installation, and the quality of the finished installation (in terms of, for example, waterproofing and aesthetics).

For example, utilization of the pitched foam support base 102 eliminates the need for creating the primary mortar bed for structural support and for pitching purposes, as well as eliminates the need for using the secondary mortar bed for pitching purposes. For example, according to exemplary embodiments, the one-piece shower base 100 may be installed as follows.

The wall for the area intended for the shower may be framed out using, for example, wood or metal studs. For example, an opening/hole for the one-piece shower base 100 to be placed into may be created by framing out the intended area. Alternatively, framing may be done around the one-piece shower base 100 after the one-piece shower base 100 has been put into place.

The one-piece shower base 100, which may be factory flood tested before sale and which already includes the integrated drain 110, is pre-pitched, and pre-primed, is placed into the opening/hole and is adhered to the subfloor 130 in the opening/hole in the location at which the one-piece shower base 100 is to be installed. For example, the pitched foam support base 102 is adhered to the subfloor 130 using an adhesive such as, for example, a thinset mortar. A primary mortar bed is not created and is not disposed between the one-piece shower base 100 and the subfloor. Rather, instead of the primary mortar bed described above with reference to the conventional shower installation, the pitched foam support base 102 provides structural support for the one-piece shower base 100 and maintains the slope of the pre-pitched bottom surface 108. Thus, in exemplary embodiments, the only layer disposed between the subfloor and the lower surface of the pitched foam support base 102 is an adhesive layer adhering the lower surface of the pitched foam support base 102 to the subfloor 130.

The upper surface of the pitched foam support base 102 has a pitch matching that of the pitched bottom surface 108 of the one-piece shower base 100, thus allowing the pitched foam support base 102 to fill the hollow space created under the one-piece shower base 100 by the pitch of the pitched bottom surface 108. This design eliminates the need to create a primary mortar bed below the one-piece shower base 100, improving installation as described above. Unlike the pitched upper surface of the pitched foam support base 102, the bottom surface of the pitched foam support base 102 (e.g., the surface that is adhered to the subfloor 130) may be substantially flat, such that it corresponds to the subfloor 130, which is also typically substantially flat. In exemplary embodiments, a shim(s) may be inserted between the subfloor 130 and the bottom surface of the pitched foam support base 102 to level the pitched foam support base 102 if necessary (e.g., if the subfloor is not substantially flat). In such an exemplary embodiment, the shim(s) is the only component other than the adhesive layer adhering the lower surface of the pitched foam support base 102 to the subfloor 130 that is disposed between the subfloor 130 and the lower surface of the pitched foam support base 102 (e.g., a primary mortar bed is not created and is not present).

Once the one-piece shower base 100 has been put into place and leveled (if necessary), the drain 110 is attached to the plumbing, and the framing 124 is created around the one-piece shower base 100 (if the framing 124 was not done prior, in which case the one-piece shower base 100 is placed into the preexisting framed space). The one-piece shower base 100 is then attached directly to the framing 124 using, for example, a screw(s), a nail(s), etc.

Once the one-piece shower base 100 has been secured to the framing 124, a backerboard 120 is mounted to the framing 124, and the wall finish 122 is adhered to the backerboard 120 (e.g., via a adhesive 126 such as, for example, a thinset mortar applied between the backerboard 120 and the wall finish 122). In exemplary embodiments, a liquid or fabric waterproofing may be applied to the backerboard 120 between the backerboard 120 and the wall finish 122. The liquid or fabric waterproofing may be applied on the backerboard 120 down to the one-piece shower base 100. The floor finish 132 may then be installed onto bottom surface 108 of the one-piece shower base 100 using an adhesive such as, for example, a thinset mortar 134.

As described above, according to exemplary embodiments, the one-piece shower base 100 includes a double flange structure including the backerboard stopper 104 and the wall finish stopper 106. Referring to FIG. 2, the backerboard stopper 104 horizontally extends inward (e.g., toward the drain 110) from an edge of at least one of the vertical flanges 112. A vertical extension portion 128 extends downward from an edge of the horizontally extending backerboard stopper 104. The wall finish stopper 106 horizontally extends inward from an edge of the vertical extension portion 128. When vertically installed onto the framing 124, the bottom of the backerboard 120 contacts and stops at the backerboard stopper 104 (e.g., a bottom end of the backerboard 120 may rest against the backerboard stopper 104). Similarly, when vertically installed onto the backerboard 120 (and onto the vertical extension portion 128, as shown in FIG. 2), the wall finish 122 contacts and stops at the wall finish stopper 106 (e.g., a bottom end of the wall finish 122 may rest against the wall finish stopper 106). Thus, the backerboard stopper 104 and the wall finish stopper 106 provide structural support for the backerboard 120 and the wall finish 122, respectively, upon installation. This improves both the ease of installation and the integrity of the finally installed shower, as the backerboard 120 and the wall finish 122 are stably held in their desired places by way of the backerboard stopper 104 and the wall finish stopper 106, respectively.

As shown in FIG. 2, a vertical flange 112 is affixed to and contacts the framing 124. The vertical flange 112 may be affixed to the framing 124 via, for example, at least one screw(s), nail(s), etc. The spatial arrangement of the backerboard stopper 104 and the wall finish stopper 106 together with the vertical flange 112 provides improved waterproofing compared to a conventional shower installation. For example, in a conventional shower installation, if water leaks through the wall finish and/or the backerboard, this water may leak into the framing behind the backerboard. This may cause damage to the framing, and/or may cause a leak below the shower, for example, in another room located below the shower. In contrast, in exemplary embodiments, if water leaks through the wall finish 122 (e.g., due to a crack or other unwanted opening formed in the wall finish 122) and/or through the backerboard 120, this water is directed into the drain 110 instead of into the framing 124 due to the formation of the backerboard stopper 104 and the wall finish stopper 106.

For example, since the backerboard 120 and the wall finish 122 are installed at an interior of the one-piece shower base 100 with respect to the adjacent vertical flange 112, and since the backerboard stopper 104 and the wall finish stopper 106 form a step structure leading down toward the drain 110, any water that leaks through the wall finish 122 and/or the backerboard 120 is directed into the drain 110. This overlapped configuration of the vertical flange 112 attached to the framing 124, the backerboard 120 installed on the vertical flange 112 and the backerboard stopper 104, and the wall finish 122 installed on the backerboard 120 and the wall finish stopper 106, creates an improved waterproof seal.

The backerboard stopper 104, the wall finish stopper 106 and the vertical flange 112 may each be made of the same material as the one-piece shower base 100. For example, when the one-piece shower base 100 is stainless steel, the backerboard stopper 104, the wall finish stopper 106 and the vertical flange 112 may also be stainless steel.

The one-piece shower base 100 may include a curbless flange 113 formed at a location corresponding to the entryway of the shower. Once the one-piece shower base 100 is installed, the curbless flange 113 may be substantially coplanar with the bathroom floor, thus permitting wheelchair access to the shower. The curbless flange 113 may directly contact the floor onto which it is installed. For example, during installation, the one-piece shower base 100 may be dropped into the hole/space created thereunder, and the curbless flange 113 may rest on the floor adjacent to the hole/space.

While the present invention has been particularly shown and described with reference to the exemplary embodiments thereof, it will be understood by those of ordinary skill in the art that various changes in form and detail may be made therein without departing from the spirit and scope of the present invention.

What is claimed is:

1. A one-piece shower base, comprising:

a pitched bottom surface;

a plurality of vertical flanges extending upward from a plurality of outer edges of the one-piece shower base;

a drain integrated within the one-piece shower base, wherein the pitched bottom surface is pitched downward in at least one direction toward the drain;

a pitched foam support base having an upper surface and a lower surface, wherein the upper surface of the pitched foam support base is adhered to an underside of the pitched bottom surface, and the lower surface of the pitched foam support base is adhered to a subfloor upon installation, wherein the lower surface of the pitched foam support base is an outermost surface of the one-piece shower base, and the pitched foam support base fills in a hollow space below the underside of the pitched bottom surface created by the pitch of the pitched bottom surface and the subfloor upon installation; and a floor finish stopper extending upward from an edge of the pitched bottom surface adjacent to the drain, wherein the floor finish stopper is configured to receive a side surface of a floor finish installed onto the pitched bottom surface.

2. The one-piece shower base of claim 1, further comprising:

a horizontally extending backerboard stopper extending inward from at least one of the vertical flanges;

a vertical extension portion extending downward from an edge of the horizontally extending backerboard stopper; and a horizontally extending wall finish stopper extending inward from an edge of the vertical extension portion, wherein the backerboard stopper is configured to receive a backerboard installed vertically onto a framing, wherein the wall finish stopper is configured to receive a wall finish installed vertically onto the backerboard.

3. The one-piece shower base of claim 2, wherein the wall finish comprises a plurality of tiles or stone.

4. The one-piece shower base of claim 1, wherein the floor finish comprises a plurality of tiles or stone.

5. The one-piece shower base of claim 1, further comprising:

a lateral stopper portion extending substantially perpendicular from a top edge of the floor finish stopper away from the drain.

6. The one-piece shower base of claim 1, wherein the pitched foam support base fills in an entirety of the hollow space below the underside of the pitched bottom surface created by the pitch of the pitched bottom surface.

7. The one-piece shower base of claim 1, wherein the lower surface of the pitched foam support base is substantially flat.

8. The one-piece shower base of claim 1, wherein the drain is a linear drain.

9. The one-piece shower base of claim 1, wherein the drain is a center drain.

10. The one-piece shower base of claim 1, wherein the one-piece shower base comprises stainless steel.

11. A method of installing a one-piece shower base, comprising:

placing the one-piece shower base on a subfloor in an opening;

adhering a pitched foam support base attached to an underside of a pitched bottom surface of the one-piece shower base onto the subfloor in the opening;

attaching a vertical flange of the one-piece shower base to a framing, wherein the vertical flange extends upward from an outer edge of the one-piece shower base;

mounting a backerboard vertically on the framing and on the vertical flange, wherein a bottom end of the backerboard contacts and rests against a backerboard stopper of the one-piece shower base upon the backerboard being mounted on the vertical flange, and the backerboard stopper horizontally extends inward from an edge of the vertical flange; and adhering a wall finish vertically to the backerboard, wherein a bottom end of the wall finish contacts and rests against a wall finish stopper of the one-piece shower base upon the wall finish being adhered to the backerboard, and the wall finish stopper horizontally extends inward from an edge of a vertical extension portion extending downward from an edge of the backerboard stopper and connecting the backerboard stopper to the wall finish stopper, wherein the floor finish is adhered directly to the pitched bottom surface of the one-piece shower base without creating a mortar bed between the pitched bottom surface and the floor finish.

12. The method of claim 11, wherein the pitched foam support base is adhered directly to the subfloor without creating a mortar bed between the pitched foam support base and the subfloor.

13. The method of claim 11, wherein the pitched foam support base fills in an entirety of a hollow space below the underside of the pitched bottom surface created by the pitch of the pitched bottom surface.

14. The method of claim 11, wherein the pitch foam support base has an upper surface and a lower surface, the upper surface of the pitched foam support base is adhered to the underside of the pitched bottom surface, and the lower surface of the pitched foam support base is adhered to the subfloor upon installation, and the lower surface of the pitched foam support base is an outermost surface of the one-piece shower base, and the pitched foam support base fills in a hollow space below the underside of the pitched bottom surface created by the pitch of the pitched bottom surface and the subfloor upon installation.

15. The method of claim 11, wherein the pitch foam support base has an upper surface and a lower surface, the upper surface of the pitched foam support base is adhered to the underside of the pitched bottom surface, and the lower surface of the pitched foam support base is directly adhered to the subfloor via an adhesive upon installation.

* * * * *